US012806537B2

(12) United States Patent
Kamiyama

(10) Patent No.: US 12,806,537 B2
(45) Date of Patent: Nov. 24, 2026

(54) DOLL HOLDER

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 165 days.

(21) Appl. No.: 18/958,276

(22) Filed: Nov. 25, 2024

(65) Prior Publication Data

US 2025/0170492 A1 May 29, 2025

(30) Foreign Application Priority Data

Nov. 27, 2023 (JP) ..... 2023-199831

(51) Int. Cl.
*A63H 3/50* (2006.01)

(52) U.S. Cl.
CPC ..... *A63H 3/50* (2013.01)

(58) Field of Classification Search
CPC ..... A63H 3/50; F16M 13/00
USPC ..... 248/176.1
See application file for complete search history.

(56) References Cited

U.S. PATENT DOCUMENTS 352,161 A * 11/1886 Staples ..... A47C 3/24 248/405
479,481 A * 7/1892 Willcox ..... F16M 11/28 223/120
1,105,519 A * 7/1914 Jessup ..... F16M 11/28 297/468
2,919,877 A * 1/1960 Gallagher ..... A63H 3/50 248/125.3
4,706,915 A * 11/1987 Cindric ..... A63H 3/50 248/161
5,549,499 A * 8/1996 Foskey ..... A63H 3/50 446/268
5,551,656 A * 9/1996 De Lozada ..... A63H 3/50 248/176.1
6,257,532 B1 * 7/2001 Ives ..... A47F 7/0028 248/146
6,739,936 B1 * 5/2004 Cotilletta ..... A63H 3/50 248/219.2
8,485,824 B2 * 7/2013 Gilbert ..... G09B 11/10 434/86

(Continued)

FOREIGN PATENT DOCUMENTS

JP 3059747 U 7/1999

*Primary Examiner* — Kurt Fernstrom
(74) *Attorney, Agent, or Firm* — Faegre Drinker Biddle & Reath LLP

(57) ABSTRACT

A doll holder includes a support shaft member and a doll clamping member. The support shaft member includes: a first end portion configured to be attachable to a portion to which the doll holder is attachable; a second end portion formed in a spherical shape; a first curved portion formed between the first end portion and the second end portion so as to be convex in a first direction; and a second curved portion formed between the first curved portion and the second end portion so as to be convex in a second direction opposite to the first direction. The doll clamping member includes: a doll clamping portion configured to clamp and hold a part of a doll; and a ball receiving portion provided to oppose the doll holding portion and configured to fit the second end portion to form a ball joint.

3 Claims, 5 Drawing Sheets

(56) References Cited

U.S. PATENT DOCUMENTS

| | | | | |
|---|---|---|---|---|
| 8,777,170 | B2 * | 7/2014 | Gilbert | A47F 7/00 24/3.12 |
| 2012/0178337 | A1 * | 7/2012 | Wittenberg | A63H 3/50 446/268 |
| 2023/0137196 | A1 * | 5/2023 | Kamiyama | A63H 3/50 446/268 |

* cited by examiner

DOLL HOLDER

CROSS-REFERENCE TO RELATED APPLICATIONS

This application is based on and claims priority under 35 USC 119 from Japanese Patent Application No. 2023-199831 filed on Nov. 27, 2023, the contents of which are incorporated herein by reference.

TECHNICAL FIELD

The present disclosure relates to a doll holder capable of holding a doll for play or display.

BACKGROUND ART

A doll holder holds a doll for play or display. For example, a doll holder disclosed in JP3059747U has two arms that are elastically deformable and form an outwardly convex curved shape. The arms are provided on a holder that is slidably provided on a bendable support.

SUMMARY OF INVENTION

A doll may be displayed for enjoyment on an installation surface, such as a desk or the like, using a doll holder as described above. However, there is a need to attach the doll to a toy for doll play to imagine the doll as if it flies around the toy. In this case, if the arms supporting the doll are visible, they may blemish the imagination of play as if the doll is flying.

An object of the present disclosure is to provide a doll holder that can be displayed for enjoyment on an installation surface, such as a desk, and can also be attached to a toy for doll play to enhance an imagination of a flying doll.

An aspect of the present disclosure provides a doll holder including: a support shaft member including: a first end portion configured to be attachable to a portion to which the doll holder is attachable; a second end portion formed in a spherical shape; a first curved portion formed between the first end portion and the second end portion so as to be convex in a first direction; and a second curved portion formed between the first curved portion and the second end portion so as to be convex in a second direction opposite to the first direction; and a doll clamping member including: a doll clamping portion configured to clamp and hold a part of a doll; and a ball receiving portion provided to oppose the doll holding portion and configured to fit the second end portion to form a ball joint.

According to the above aspect, it is possible to provide a doll holder that can be displayed for enjoyment on an installation surface, such as a desk, and can also be attached to a toy for doll play to enhance an imagination of a flying doll.

BRIEF DESCRIPTION OF DRAWINGS

The present disclosure will be described in detail based on the following without being limited thereto, wherein:

FIG. 3 is a perspective view showing an aspect in which the doll holder according to the embodiment of the present disclosure is displayed on a desk or the like;

FIG. 4 is a side view showing a state in which the doll holder according to the embodiment of the present disclosure is provided on a wall surface of a toy for doll play or the like.

DESCRIPTION OF EMBODIMENTS

Figure 1:
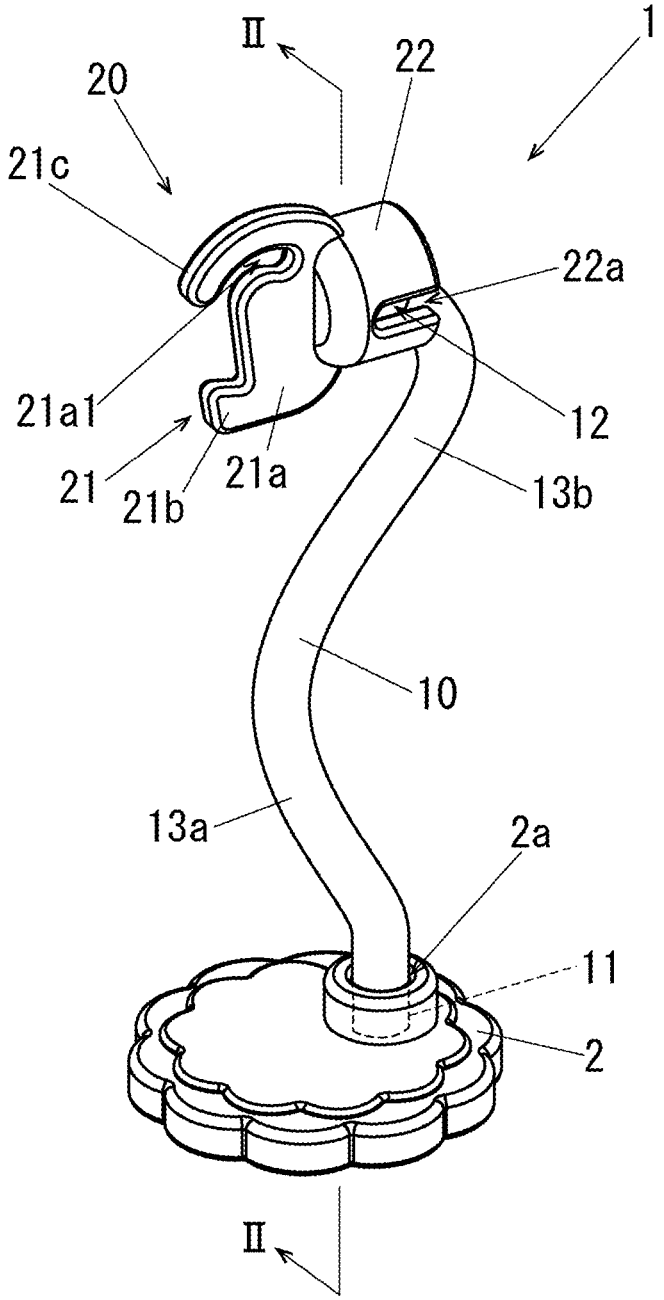
FIG. 1 is a perspective view of a doll holder according to an embodiment of the present disclosure.
Figure 2:
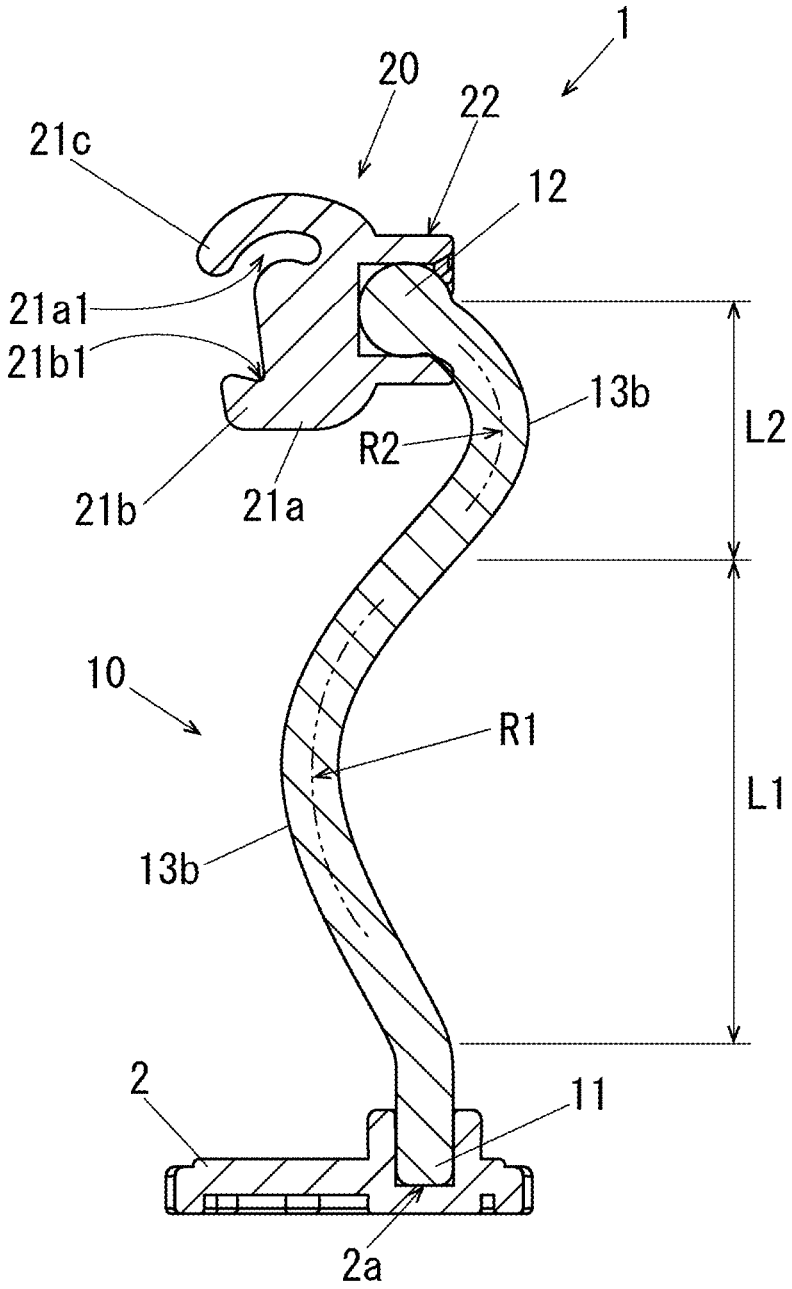
FIG. 2 is a cross-sectional view taken along line II-II of FIG. 1 of the doll holder according to the embodiment of the present disclosure.

An embodiment of the present disclosure will be described below with reference to the drawings. A doll holder 1 shown in FIGS. 1 and 2 is supported on a base member 2. The doll holder 1 includes a support shaft member 10 and a doll clamping member 20. The support shaft member 10 is formed in a substantially rod-like shape with a wavy curve, and has a first end portion 11, which is an end portion on one side (the lower side in FIGS. 1 and 2), and a second end portion 12, which is an end portion on the other side (the upper side in FIGS. 1 and 2). The support shaft member 10 is formed to have substantially the same diameter, except for the second end portion 12.

The first end portion 11 is formed to be insertable into an insertion hole 2*a* provided in the base member 2 (a portion to which the doll holder 1 is attachable). The base member 2 is formed in a substantially circular plate shape and has an insertion hole 2*a* provided at an eccentric position to allow the doll to be displayed in a balanced manner. The insertion hole 2*a* is formed as a circular recessed portion protruding from an upper surface of the base member 2. The first end portion 11 is formed in a substantially straight cylindrical shape. The first end portion 11 and the insertion hole 2*a* are fitted with each other to a degree that the first end portion does not come off easily.

The first end portion 11 connects to a first curved portion 13*a*. The first curved portion 13*a* is curved to be convex leftward in a side view of FIG. 2. The first curved portion 13*a* connects to a second curved portion 13*b* on the second end portion 12 side. The second curved portion 13*b* is curved to be convex toward an opposite side to the first curved portion 13*a*. Specifically, in a side view of FIG. 2, the second curved portion 13*b* is curved to be convex rightward. In other words, the second curved portion 13*b* is curved (convex rightward) toward the opposite side to the first curved portion 13*a* (convex leftward).

The first curved portion 13*a* and the second curved portion 13*b* are both curved in an arc shape. As shown in FIG. 2, when a bending radius of the first curved portion 13*a* is R1 and a bending radius of the second curved portion 13*b* is R2, then R1>R2. Therefore, a curvature (1/R2) of the second curved portion 13*b* is greater than a curvature (1/R1) of the first curved portion 13*a*. With this, a length L1 of the first curved portion 13*a* is formed to be longer than a length L2 of the second curved portion 13*b* (L1>L2).

The doll clamping member 20 includes a doll clamping portion 21. The doll clamping portion 21 is formed in a substantially plate-like shape and has a protrusion 21*b* protruding from a clamping main body 21*a* and an elastic protrusion 21*c* provided to oppose the protrusion 21*b*. A connecting portion 21*b*1 on the elastic protrusion 21*c* side between the protrusion 21*b* and the clamping main body 21*a* is formed at an acute angle.

The elastic protrusion 21*c* is formed in a substantially arc shape to bulge out from the clamping main body 21*a* toward the protrusion 21*b*. The clamping main body 21*a* is formed with an arc-shaped slit 21*al* to follow the elastic protrusion 21*c*. The elastic protrusion 21*c* has elastic force. Therefore, a part of a doll can be clamped and held between the protrusion 21*b* and the elastic protrusion 21*c*.

The doll clamping member 20 includes a ball receiving portion 22 provided to oppose the doll clamping portion 21 and configured to fit with the spherical second end portion 12 to form a ball joint. The ball receiving portion 22 integrally connects to the clamping main body 21*a* and is formed in a substantially bottomed cylindrical shape. A side surface of the ball receiving portion 22 is provided with a pair of facing slits 22*a*. An inner diameter of the ball receiving portion 22 is formed to be slightly smaller than a ball diameter of the second end portion 12. Accordingly, when the second end portion 12 is inserted into the ball receiving portion 22, an inner diameter portion of the ball receiving portion 22 expands by the slits 22*a*, generating elastic force that holds the second end portion 12. A depth of the inner diameter portion of the ball receiving portion 22 is formed to a depth sufficient to accommodate the second end portion 12. In this way, a ball joint is configured by the inner diameter portion of the ball receiving portion 22 and the second end portion 12. Accordingly, the doll clamping member 20 is allowed to slide freely around the spherical second end portion 12 and can be held stationary at any desired position.

Figure 3:
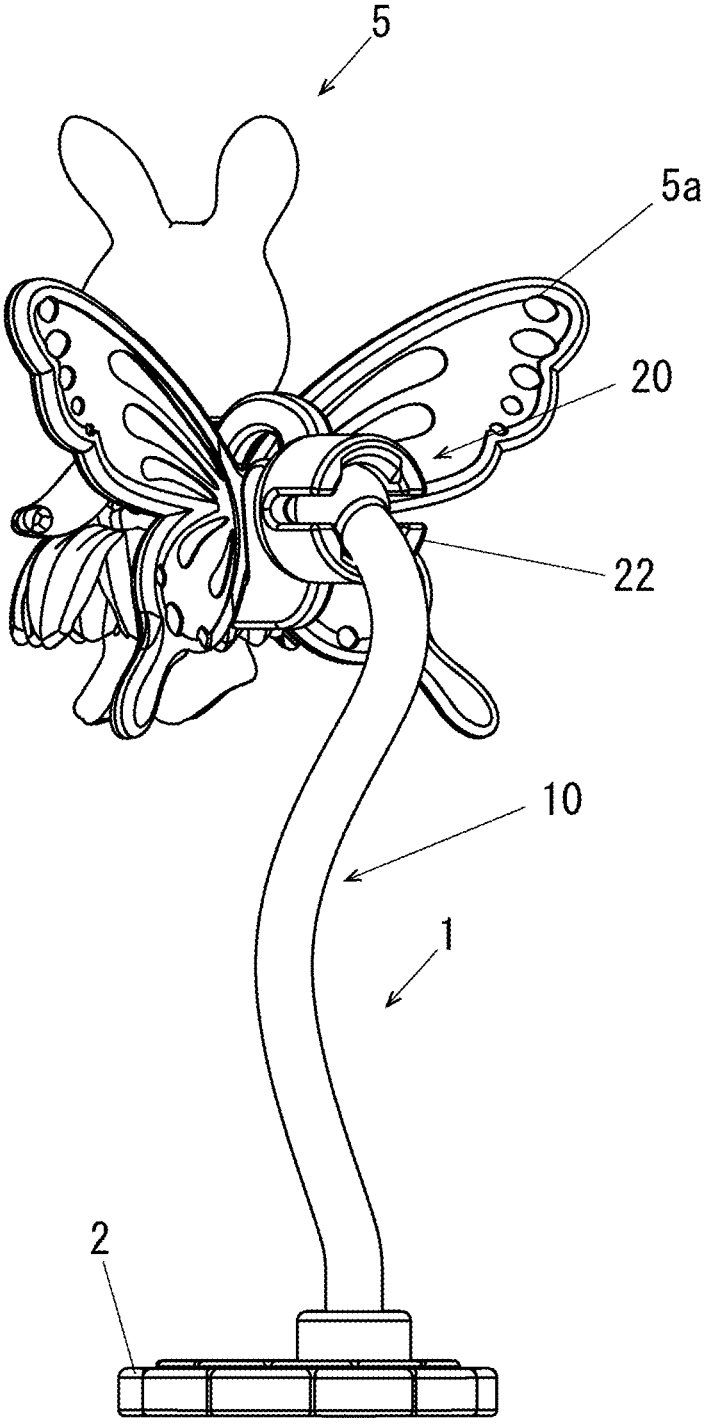

As shown in FIG. 3, the doll holder 1 can be installed on a desk or the like by being attached to the base member 2. Arranging the protrusion 21*b* and the elastic protrusion 21*c* in the vertical direction allows, for example, a doll 5 to be attached to the doll holder 1 by clamping a central portion of a butterfly-like wing portion 5*a* attached to the back of the doll 5. By adjusting a direction of the doll holder 21 using the ball joint, the doll 5 can be displayed with an aesthetic appearance on a desk or the like.

Note that when the protrusion 21*b* and the elastic protrusion 21*c* are oriented horizontally, the doll can be installed and displayed on a desk or the like while clamping, for example, a torso portion of the doll.

Figure 4:
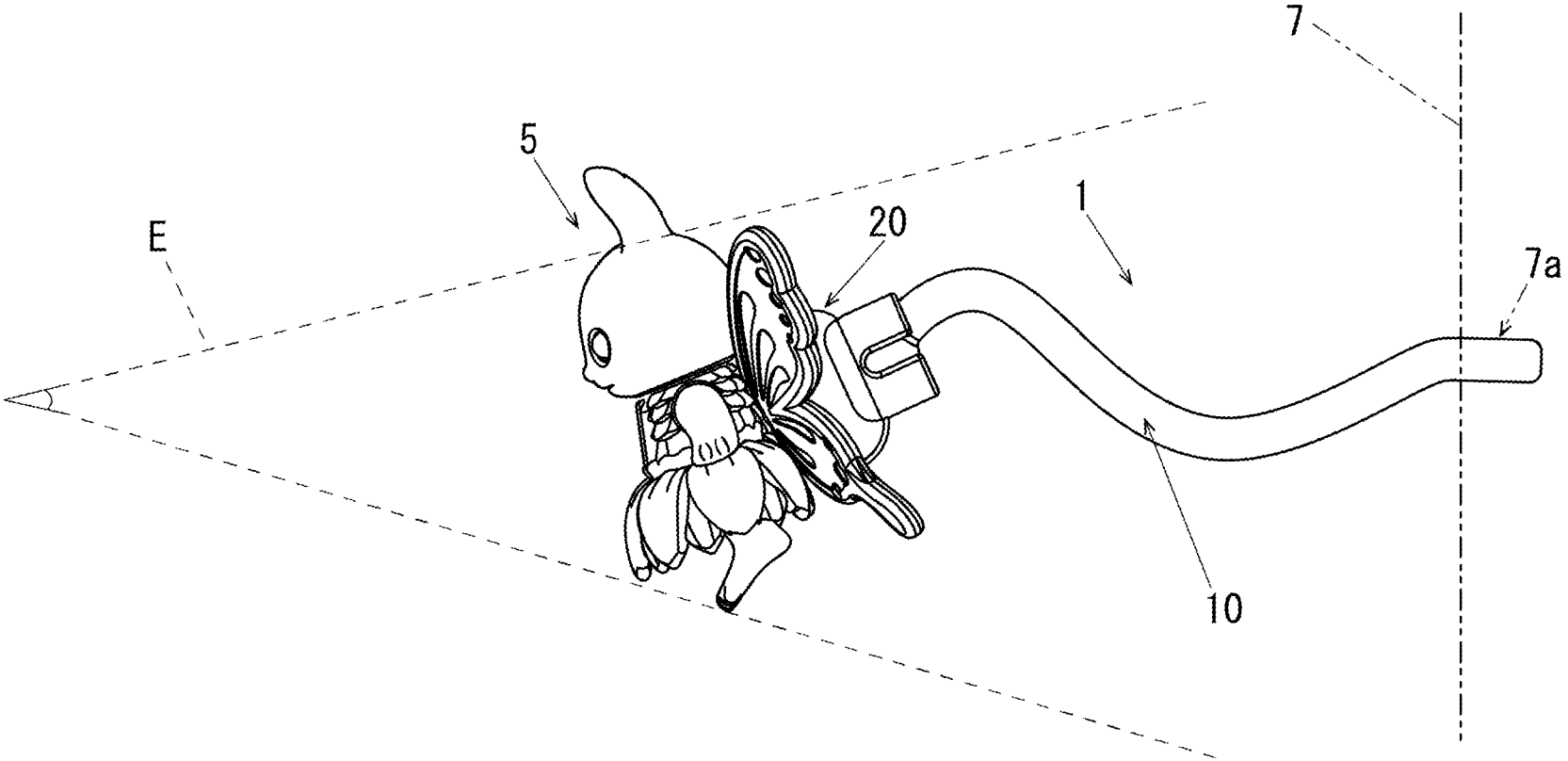

Alternatively, as shown in FIG. 4, the doll holder 1 can be attached, as if the doll 5 is flying while looking downward, by inserting the first end portion 11 into an insertion hole 7*a* provided in a wall surface or the like of a toy 7 for doll play (a portion to which the doll holder 1 is attachable). In this case, by adjusting the direction of the doll clamping member 20 with the ball joint, the doll holder 1, particularly the support shaft member 10, can be concealed on the rear side of the doll 5 within a range of the user's line of sight E indicated by the broken line, so that the user can enjoy seeing the doll 5 as if it were floating in the air in the toy 7 for doll play.

According to the embodiment of the present disclosure, a doll holder of the following aspects can be provided.

A doll holder according to a first aspect includes: a support shaft member including: a first end portion configured to be attachable to a portion to which the doll holder is attachable; a second end portion formed in a spherical shape; a first curved portion formed between the first end portion and the second end portion so as to be convex in a first direction; and a second curved portion formed between the first curved portion and the second end portion so as to be convex toward a second direction opposite to the first direction; and a doll clamping member including: a doll clamping portion configured to clamp and hold a part of a doll; and a ball receiving portion provided to oppose the doll holding portion and configured to fit the second end portion to form a ball joint.

According to this configuration, it is possible to provide a doll holder whereby, when the first end portion is attached to a base member, the doll holder can be displayed on a desk or the like, and when attached to a toy for doll play or the like, the curved support shaft member is concealed in the shadow of the doll and becomes difficult to see, allowing the doll holder to be displayed for enjoyment on an installation surface such as a desk, while also allowing an imagination of the doll appearing to fly to be enhanced by being attached to a toy for doll play or the like.

In the doll holder according to a second aspect, a curvature of the second curved portion is greater than a curvature of the first curved portion.

According to this configuration, when a doll is held and displayed on a wall surface of a toy for doll play or the like, the support shaft member can be further concealed in the shadow of the doll, making it more difficult to see.

In the doll holder according to a third aspect, the doll clamping portion includes: a clamping main body; a protrusion protruding from the clamping main body; and an elastic protrusion provided to oppose the protrusion and protruding from the clamping main body in a convex curved shape to have elasticity.

According to this configuration, one side is configured as a fixed protrusion, and the other side is configured as an elastic protrusion with elasticity, allowing the doll to be securely held.

Figure 5:
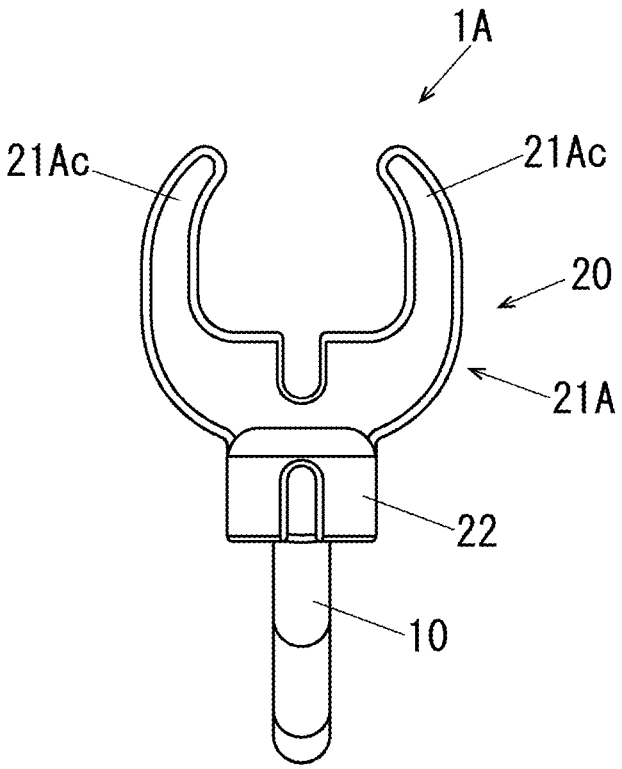
FIG. 5 is a plan view showing a doll holder according to a modification of the embodiment of the present disclosure.

Although the embodiments of the present disclosure have been described, the present disclosure is not limited to the above-described embodiments and can be variously changed without departing from the gist. For example, in a doll holder 1A according to a modification shown in FIG. 5, a doll clamping portion 21A may include elastic protrusions 21Ac having elasticity and provided to oppose each other, while omitting the protrusion 21*b* of the present embodiment. With this configuration, a larger doll can be clamped and held by the doll holder 21A.

What is claimed is:

1. A doll holder comprising:

a support shaft member comprising:

a first end portion configured to be attachable to a portion to which the doll holder is attachable;

a second end portion formed in a spherical shape;

a first curved portion formed between the first end portion and the second end portion so as to be convex in a first direction; and a second curved portion formed between the first curved portion and the second end portion so as to be convex in a second direction opposite to the first direction; and a doll clamping member comprising:

a doll clamping portion configured to clamp and hold a part of a doll; and a ball receiving portion provided to oppose the doll holding portion and configured to fit the second end portion to form a ball joint.

2. The doll holder according to claim 1, wherein a curvature of the second curved portion is greater than a curvature of the first curved portion.

3. The doll holder according to claim 1, wherein the doll clamping portion comprises:

a clamping main body;

a protrusion protruding from the clamping main body; and an elastic protrusion provided to oppose the protrusion and protruding from the clamping main body in a convex curved shape to have elasticity.

* * * * *